US006442900B1

(12) United States Patent
Kvasnes

(10) Patent No.: US 6,442,900 B1
(45) Date of Patent: Sep. 3, 2002

(54) SLIDING PANEL, SUITED TO SERVE AS A SLIDING DOOR OR WINDOW

(76) Inventor: Olav Johan Silseth Kvasnes, Urdalsbygget, Vegsund, N-6012 Ålesund (NO)

( * ) Notice: Subject to any disclaimer, the term of this patent is extended or adjusted under 35 U.S.C. 154(b) by 0 days.

(21) Appl. No.: 08/549,828

(22) PCT Filed: May 6, 1994

(86) PCT No.: PCT/NO94/00085

§ 371 (c)(1),
(2), (4) Date: Nov. 3, 1995

(87) PCT Pub. No.: WO94/27015

PCT Pub. Date: Nov. 24, 1994

(30) Foreign Application Priority Data

May 11, 1993 (NO) ..... 931706

(51) Int. Cl.[7] ..... E05D 13/00
(52) U.S. Cl. ..... 49/409; 49/410
(58) Field of Search ..... 49/209, 211, 223, 49/222, 221, 225, 409, 410, 411, 316, 318, 320, 321, 449, 452

(56) References Cited

U.S. PATENT DOCUMENTS 845,989 A * 3/1907 Wideman ..... 49/223
995,960 A * 6/1911 Gray ..... 49/223
1,054,377 A * 2/1913 Weidrich ..... 49/223
1,106,233 A * 4/1914 Mueller ..... 49/223
2,740,168 A * 4/1956 Wright ..... 49/222
3,199,155 A * 8/1965 Coleman ..... 49/409
3,774,342 A * 11/1973 Thom ..... 49/449
4,624,074 A * 11/1986 Shuttleworth ..... 49/222
5,356,185 A * 10/1994 Cameron ..... 49/449
5,450,693 A * 9/1995 Tarrega ..... 49/409

* cited by examiner

*Primary Examiner*—Curtis A. Cohen
(74) *Attorney, Agent, or Firm*—Francis C. Hand; Carella, Byrne, etal

(57) ABSTRACT

The sliding door is secured by a locking mechanism in a closed position wherein the sliding panel is held against a frame. When the locking mechanism is released, the weight of the sliding door causes the panel to move away from the frame while tilting the wheels in which the sliding panel slides into tilted positions. The panel is then free to roll along guide rails on the tilted wheels. When in the closed position, seals on the movable panel seal against the frame. During travel of the panel, the seals are in spaced relation to the frame.

15 Claims, 6 Drawing Sheets

FIG. 1
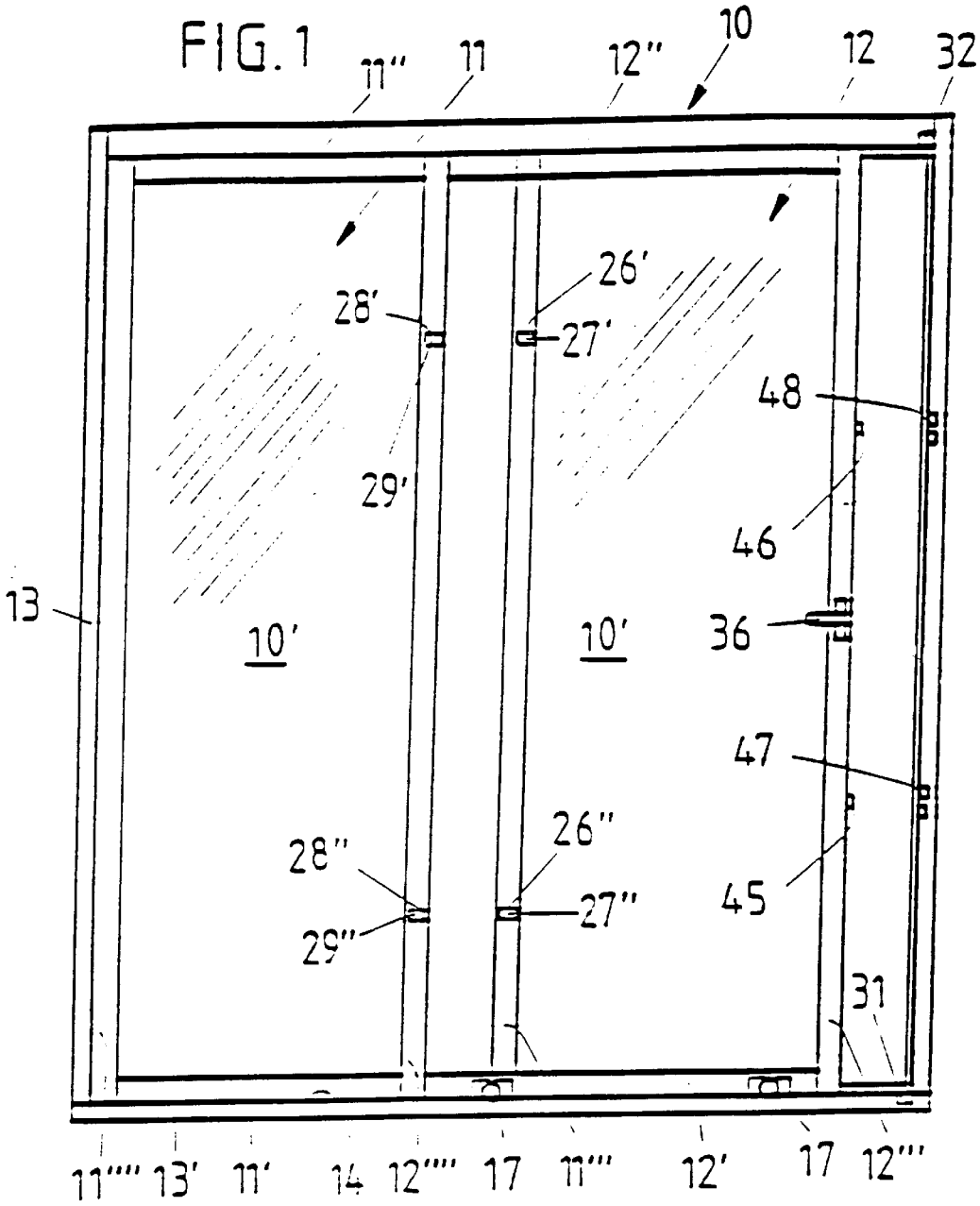
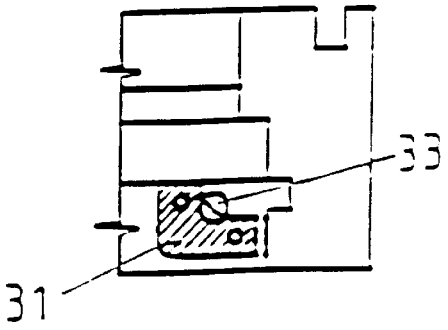
FIG. 10
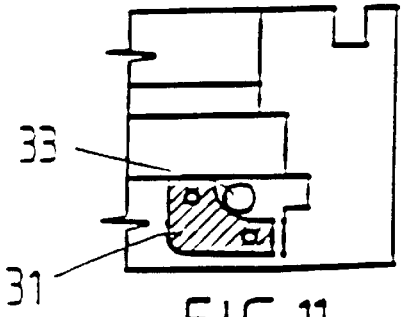
FIG. 11

FIG. 3A
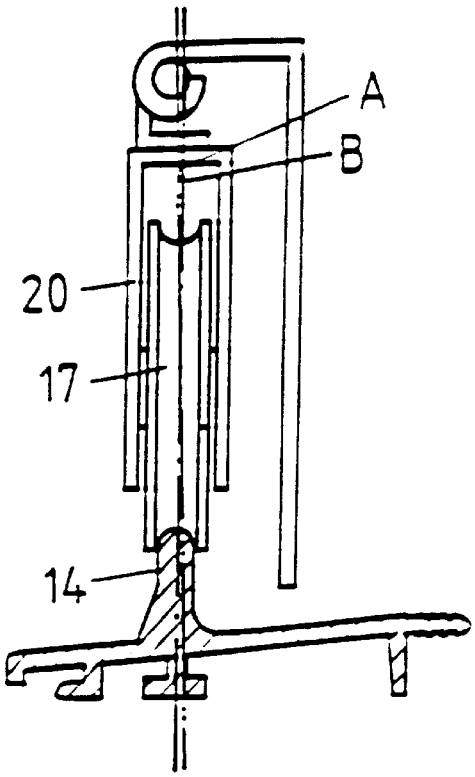
FIG. 3B
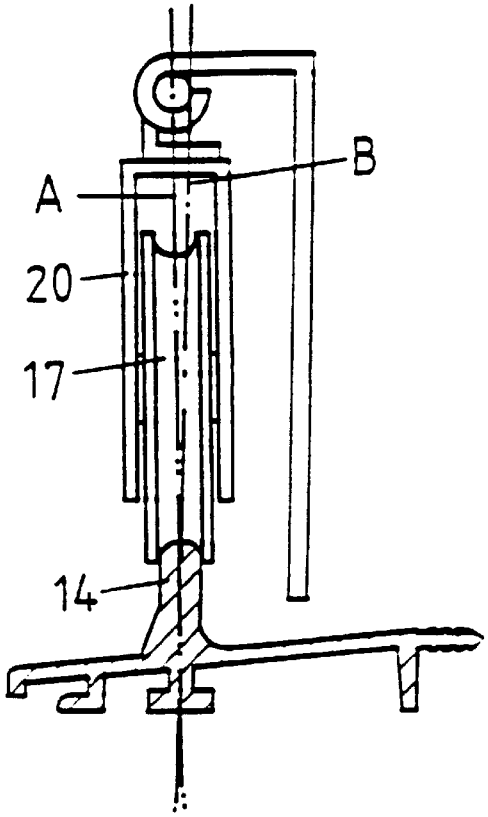
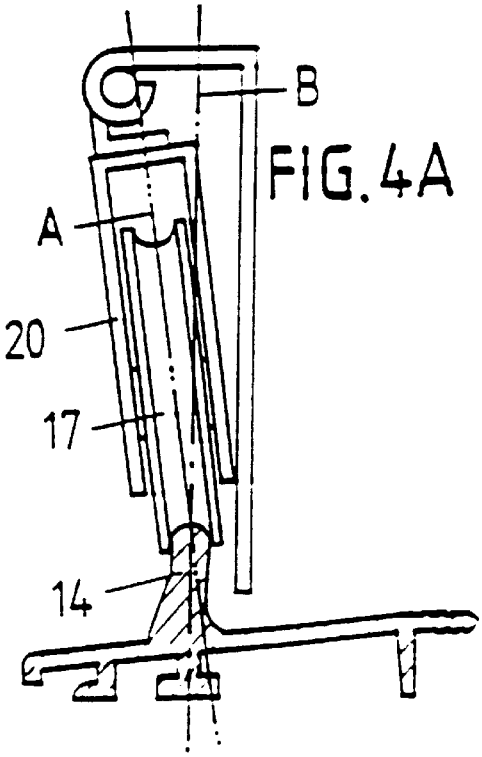
FIG. 4A
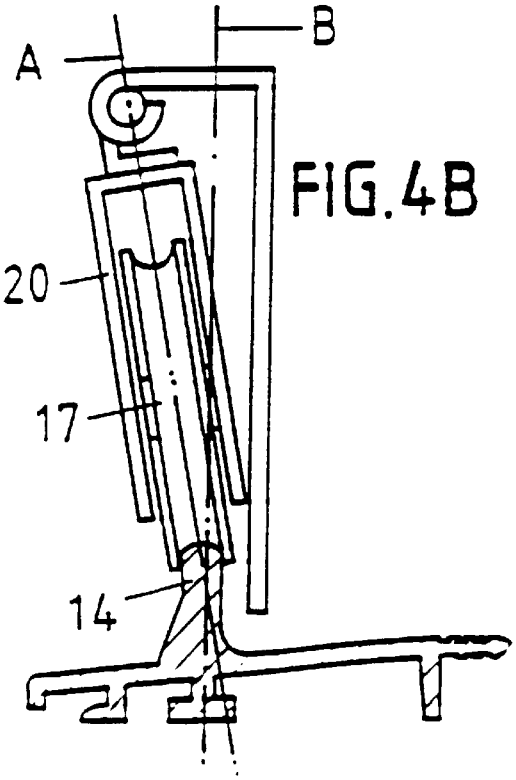
FIG. 4B

FIG. 5
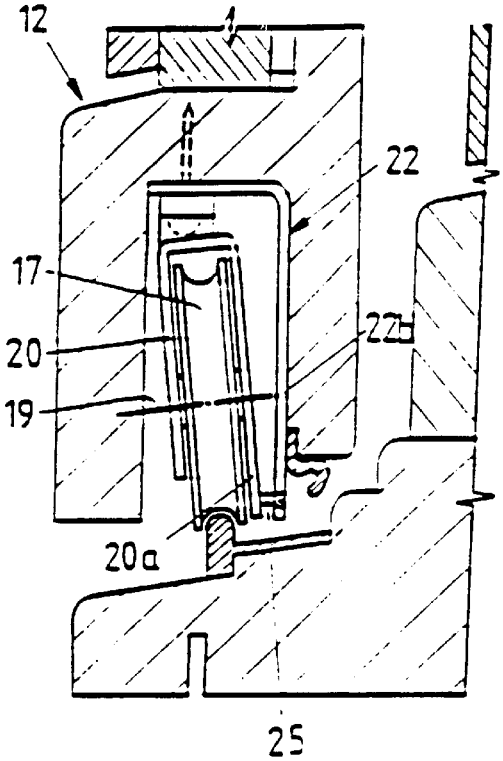
FIG. 9
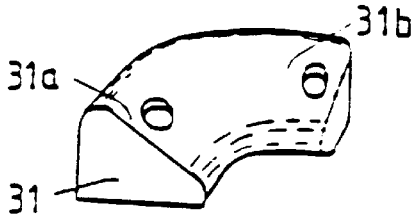
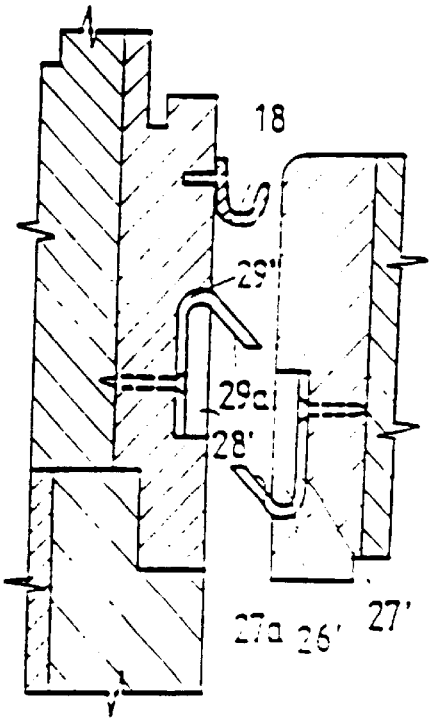
FIG. 6
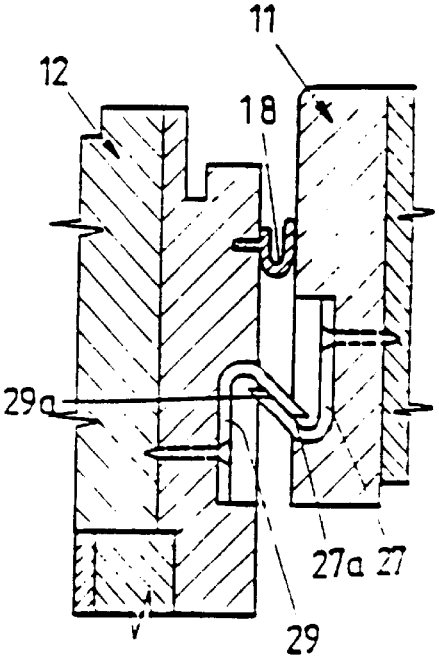
FIG. 7

SLIDING PANEL, SUITED TO SERVE AS A SLIDING DOOR OR WINDOW

The present invention relates to a sliding panel, suited to serve as a sliding door or window supportable in horizontal guides in an associated frame, having received within its lower horizontal extent at least one fitting containing a wheel or slide element for horizontal displacement of the sliding panel in a slide position in said horizontal guides. Each wheel is rotatably mounted in its associated fitting about a first axis arranged in a plane transversely of the main plane of the sliding panel. Each fitting is pivotable relative to the sliding panel about a second axis at right angles to the plane of the first axis, and the sliding panel is readjustable about the second axis by lateral displacement of the sliding panel towards and from a support position with support via sealing elements against the frame and against the support panel respectively, by displacement of the sliding panel from and to a stable sliding position at a lateral distance from the frame and the support panel respectively.

By the term "sliding door" shall be understood conventional sliding doors for housing, offices, industrial locations, that is to say doors indoors as well as out-doors but also sliding doors for special purposes, such as fireproof doors, cupboard doors and the like. Correspondingly there shall be understood by the term "sliding window" conventional, vertical, external sliding windows for housing, offices, industrial locations, and the like, but also external, obliquely extending sliding windows for use as roof windows or the like plus internal sliding windows for use in connection with special rooms of different kinds.

It is usual that sliding doors and sliding windows are supported in adjacent guides via wheels and/or slide elements, which can be arranged at the upper end of the sliding panel and/or at its lower end. It is usual to employ rails or similar slide surfaces as guides for controlling the wheels or the slide elements in the intended manner relative to the support panel.

Furthermore it is usual in connection with sliding windows and sliding doors to employ sealing elements in the form of sliding strips for forming a seal between the sliding panel and the support panel. Such sliding strips easily cause great inertia between sliding panel and support panel during displacement of the sliding panel relative to the support panel and can have a tendency to form little effective sealing in the desired sealing position.

A solution according to DE-A-2 941 109 is regarded as the closest prior art in the matter, and comprises a pivot-slide fitting for wheels which supports sliding windows and sliding doors in an outwardly pivoted sliding position or in an inwardly pivoted support position. The pivotal movement takes place on lifting and subsequently lowering the sliding panel about an unstable dead centre from two respective stable-outer positions, which constitute the respective sliding position and support position of the sliding panel. In this connection the plane through the second pivotal axis is coincident with the radial plane through the wheels. In the known solution, the weight of the sliding panel is utilised as the force to ensure the sliding panel in place in opposite outer positions. One is hereby dependent upon a sliding force across the sliding panel in order to be able to accomplish the pivoting from outer position to outer position.

In U.S. Pat. No. 2,570,563 there is shown a similar pivoting about of the sliding panel between stable sliding position and stable support position via an intermediate upper dead centre position.

From U.S. Pat. No. 2,199,182 a solution is known where by means of a sliding arm the pivot pin of the support wheels can be swung about between a position inclined obliquely inwards and a position inclined obliquely outwards for equivalent readjustment of the sliding panel between a stable support position and a stable sliding position. In this case also the sliding panel must be lifted and thereafter lowered about an intermediate dead centre between the two outer positions.

It is an object of the invention to be able to utilise the weight of the sliding panel as a force for readjusting the sliding panel in the one pivotal direction It is another object of the invention to forcibly guide the sliding panel into place in an unstable support position by way of separate means, so that the sliding panel can be readjusted in an easy manner from unstable support position to stable sliding position by simple means, that is to say by the weight of the sliding panel.

In connection with lifting and lowering of the sliding panel, an aim according to the invention is to make oneself independent of a dead centre between the outer positions of the sliding panel.

According to the invention a special aim is to combine a forcible guiding of the sliding panel with a barring of the sliding panel in the support position, at the same time as there is exerted a controlled clamping between sliding panel and casement via intermediate packings More specifically an aim is to be able to displace the sliding panel relatively unhindered in a released, stable sliding position, while a sealing engagement is activated between sliding panel and support panel via intermediate sealing elements in the intended support and sealing position, in a controlled, accurate, forcibly guided manner.

The sliding panel of the present invention is characterised in that, independently of the respective position of the sliding panel relative to the horizontal guide, the second axis is always laterally offset in a direction which faces away from said frame relative to a central vertical plane through the associated guide, and preferably also relative to a middle radial plane through the associated wheel or slide element. The sliding panel is arranged to attain a sliding position at a lower level than the closed position. Further a manually actuable locking means, which forceably bars the sliding panel in its support position in a weight loaded, unstabilised manner, is arranged to release a combined downwards and sidewise movement of the sliding panel from its upper unstabilised support position towards its lower weight stabilised sliding position. Upon release of the sliding panel from its closed position, the weight of the sliding panel is arranged to be loaded on each of the lower wheels or slide elements through the second axis, causing movement of the sliding panel from the upper closed position to the lower sliding position.

It is possible to allow the support wheels to run obliquely disposed from below and outwards both in the sliding position and in the support position, that is to say inclining in the support position slightly obliquely outwards and in the sliding position inclining more severely obliquely outwards. This can for example be achieved by allowing an axis through the radial central plane of the support wheel to coincide with the second axis. A break point can hereby be ensured between sliding panel and support wheel, that is to say an unstable wheel position in the support position, where the weight of the sliding panel can exert a turning moment towards the wheel in the support position and ensure that the wheel is tilted around about a tilting axis on the associated guide, while the sliding panel is equivalently tilted around about the second axis.

However it is preferred that the central radial plane of the support wheel, in the support position of the slidimg panel, coincides with a vertical plane through the associated guide. In its support position the weight of the sliding panel can hereby be transferred vertically through the support wheels. By locating the second axis laterally displaced relative to the vertical plane through the associated guide, a moment arm between the second axis and the vertical plane through the associated guide will exert a constant turning moment towards the support wheel and ensure that the sliding panel is forcibly guided from support position to sliding position by means of its weight.

According to the invention a relatively simple solution is produced, where a controlled side displacement of the sliding panel is ensured relative to, that is to say towards and from the support panel for easy readjustment of the sliding panel from sliding position to support position or seal-forming position.

Purely as to use it is an advantage that the sliding panel is readily swingable, that is to say automatically swingable from support position to sliding position, so that the sliding panel will be in readiness for the sliding movement, immediately the barring engagement is removed In other words with a simple removal of the barring engagement, one can ensure, as a result of the unstable position of the sliding panel in the support position and the weight loading which is exerted from the sliding panel towards the support wheels, an automatic readiness of the sliding panel for sliding movement immediately the barring engagement of the locking means ceases. Correspondingly it is an advantage that the forcible guidance of the sliding panel sideways from sliding position to support position can take place by readjusting the locking means from inactive to active position, since one can thereby achieve positively the intended locking position at the same time as an intended, controlled sealing abutment is ensured between sliding panel and frame.

By a simple actuation of the locking means it is consequently possible to readjust the sliding panel between the support position, in which effective sealing between the sliding panel and the support panel is ensured, and the released sliding position by means of the weight of the sliding panel. This can be guaranteed in a first instance by arranging a horizontal axis at the upper end of the sliding panel, that is to say in a case where the sliding panel is suspended in a hanging position in an upper guide, or alternatively, in a second instance by arranging the horizontal axis at the lower end of the sliding panel, that is to say in a case where the sliding panel rests with its whole weight against a lower guide. It will also be possible to arrange a first horizontal axis at the lower end of the sliding panel and a second horizontal axis at the upper end of the sliding panel, for example by employing a wheel support at the lower end of the sliding panel and a slide element support at the upper end of the sliding panel or a wheel support at both the upper and lower ends. Various joint arm mechanisms can be considered for use and as required differing or largely similar mechanisms at upper and lower ends of the sliding element.

However a solution is preferred for the sake of simplicity which is characterised in that the horizontal axis is arranged at the lower end of the sliding panel on or at the side of the sliding panel which faces away from the sliding panel. In other words a horizontal axis is preferred only at the lower end of the sliding panel, while the upper end is more or less freely moveable.

In the last-mentioned, preferred construction the advantage is obtained that the sliding panel is forcibly guided laterally outwards by way of especially simple means at the same time as it is lowered somewhat downwards relative to the support position, mainly as a result of the unstable support position and the weight of the sliding panel, but if necessary also with the possibility for lateral pushing out of the sliding panel by means of the inherent elasticity of the sealing elements. By way of various means it will also be possible to forcibly guide the upper end of the sliding panel in a direction laterally outwards from the sliding panel.

Further details will be evident from the following description having regard to the accompanying drawings, in which:

FIGS. 1 and 2 show a sliding door according to the invention, illustrated in side view and end view respectively

FIGS. 3A and 4A show a detail of FIGS. 3 and 4, illustrated in schematic form.

FIGS. 3B and 4B show an alternative construction of the detail as illustrated in FIGS. 3 and 4.

FIG. 5 shows in vertical section, corresponding to the section of FIG. 4, a detail according to an alternative construction.

FIGS. 6 and 7 show in horizontal section the one end edge portion of the sliding panel and the support panel in the sliding position, FIG. 6, of the sliding panel and in the support position, FIG. 7, of the sliding panel, illustrated with an associated cooperating, first set of guide members.

FIG. 9 shows in perspective another kind of guide member.

Figures 12, 13, 14:
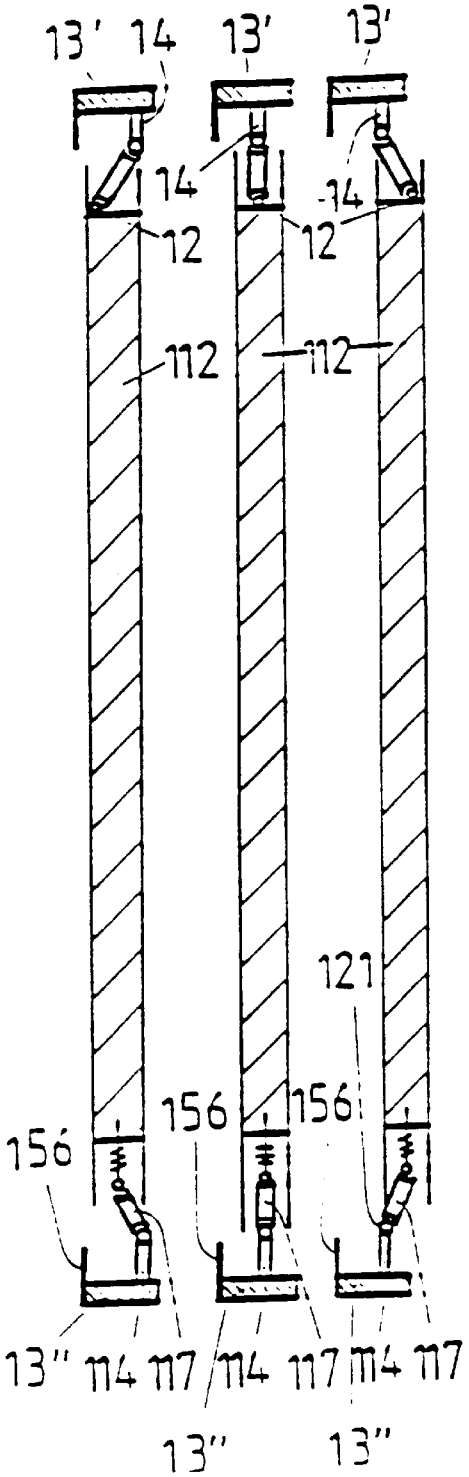

FIGS. 10 and 11 show in horizontal section the lower portion of the support panel with an associated second set of guide members and with an espagnolette member illustrated in FIG. 10 in the sliding position of the sliding panel and in FIG. 11 in the support position of the sliding panel, FIGS. 12–14 show schematically in end view a modified construction of the sliding door according to the invention.

Figure 15:
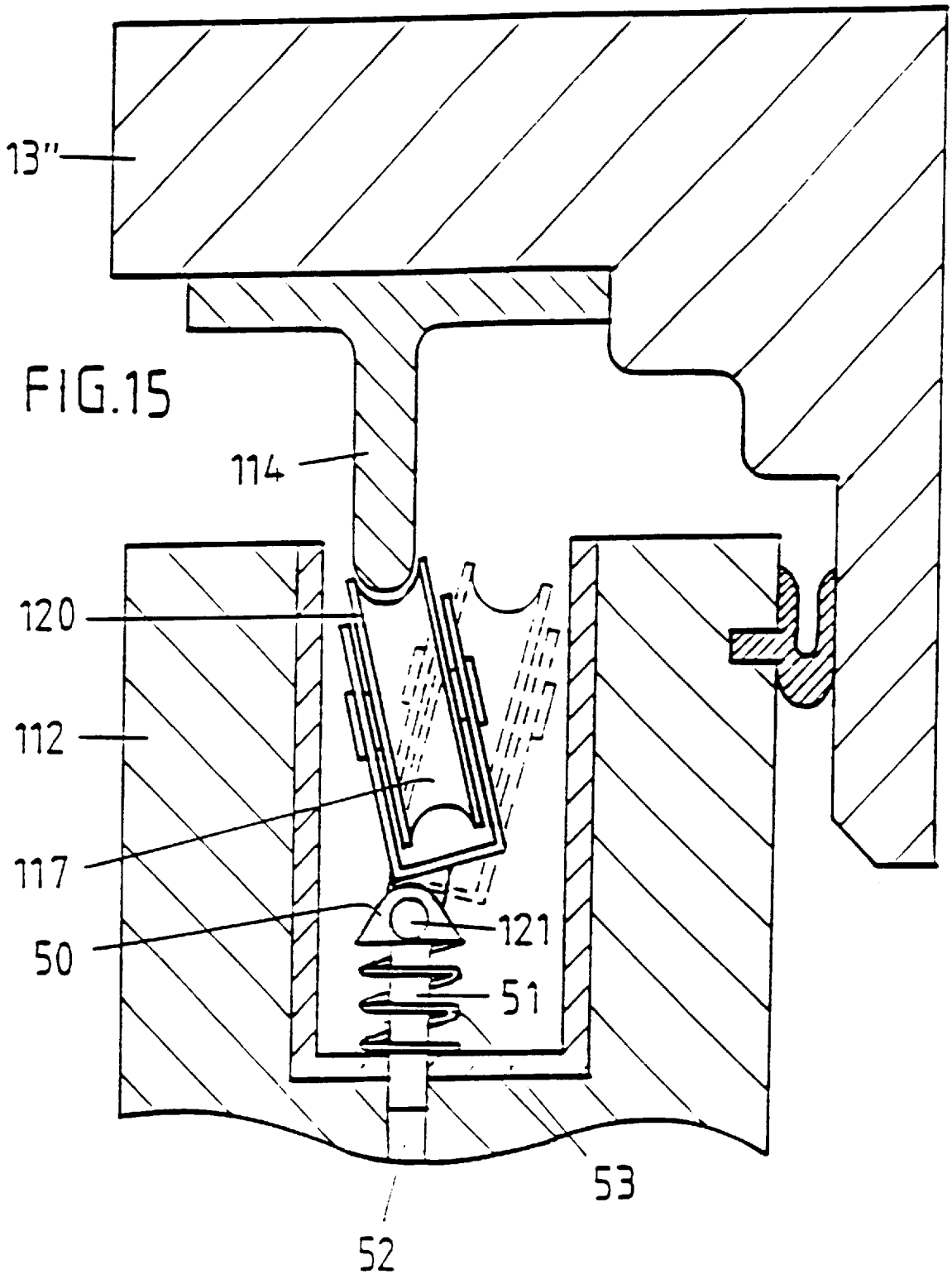

FIG. 15 shows a detail in the modified sliding door according to FIGS. 12–14.

Figure 2:
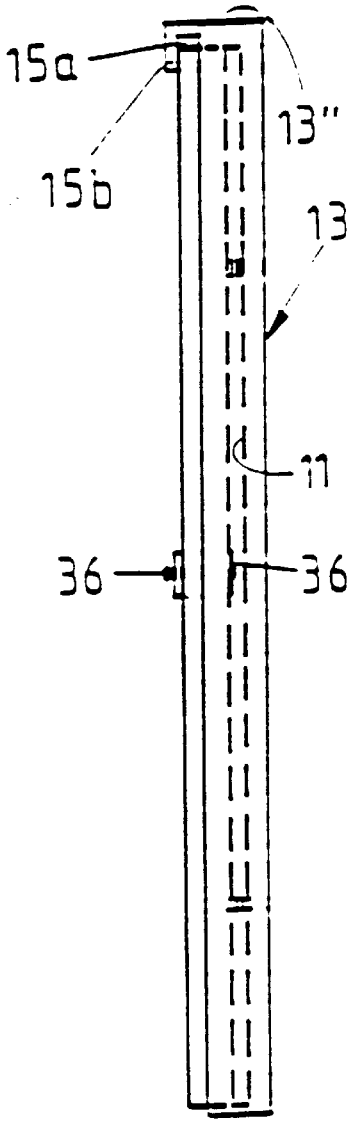

In FIGS. 1 and 2 the invention is shown in the form of a conventional sliding door 10, comprising a stationary support panel 11 and a horizontally moveable sliding panel 12. There is shown as an example the support panel 11 and in the sliding panel 12 a window pane 10' is shown received between support panel pieces 11'–11"" made of wood, metal or another suitable material and a window pane 10" received between sliding panel pieces 12'–12"" correspondingly made of wood, metal or another suitable material. Alternatively the support panel and/or the sliding panel can be made of continuous, transparent or opaque, sheet-formed parts or a combination of materials differing from that which is shown herein.

The support panel 11 is surrounded by a rigid frame 13 having a lower horizontal guide in the form of a guide rail 14 fastened to a horizontal lower frame piece 13' and an upper horizontal guide in the form of a guide duct **15*a* having an associated, readily dismountable outer cover 15*b* fastened to a horizontal upper frame piece 13"**.

The guide rail 14 is provided with a convexly rounded, upwardly facing guide surface **14*a* which is adapted to support and guide the sliding panel 12 via castor-formed wheels 17 or suitable slide elements (not shown further) relative to the frame 13. The castor-formed wheels 17 are adapted to be supported in various oblique positions on the guide surface 14***a*, as is illustrated in FIGS. 3 and 4.

The wheels 17 are fastened to the lower piece 12' of the sliding panel 12 and carry in the illustrated embodiment the whole weight of the sliding panel which is relieved in the guide rail 14. The guide duct 15*a* gives only side support for the sliding panel 12 via the outer cover 15*b* and an upper horizontal support panel piece 11", without absorbing any of the weight of the sliding panel.

In FIG. 2 the sliding panel 12 is shown in the sliding position on the guide rail 14, that is to say in a released position pushed laterally outwards relative to the support panel 11 itself.

Figure 3:
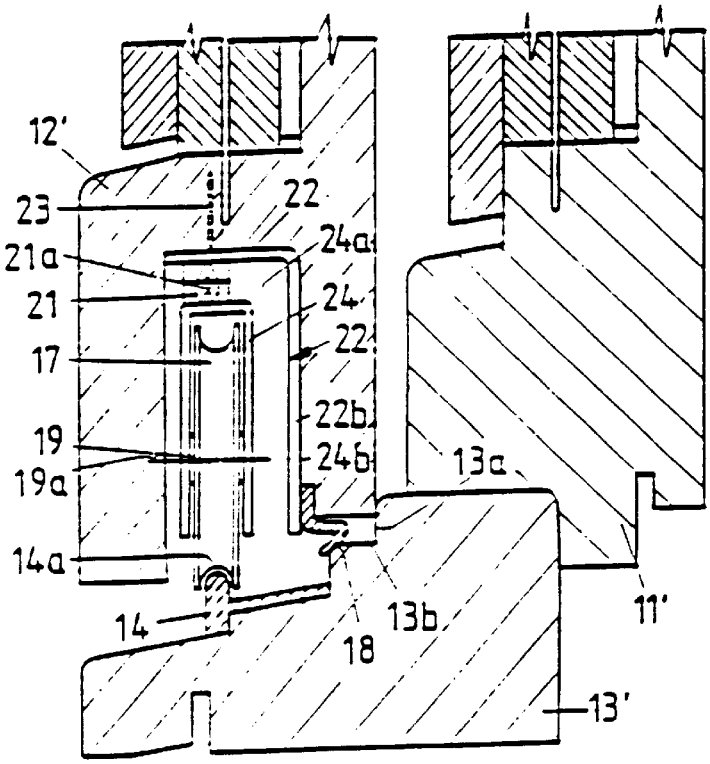
FIGS. 3 and 4 show a vertical section of the lower portion of a sliding panel and the lower portion of a cooperating support panel, with the sliding panel illustrated in the support position in FIG. 3 and in the released sliding position in FIG. 4.
Figure 4:
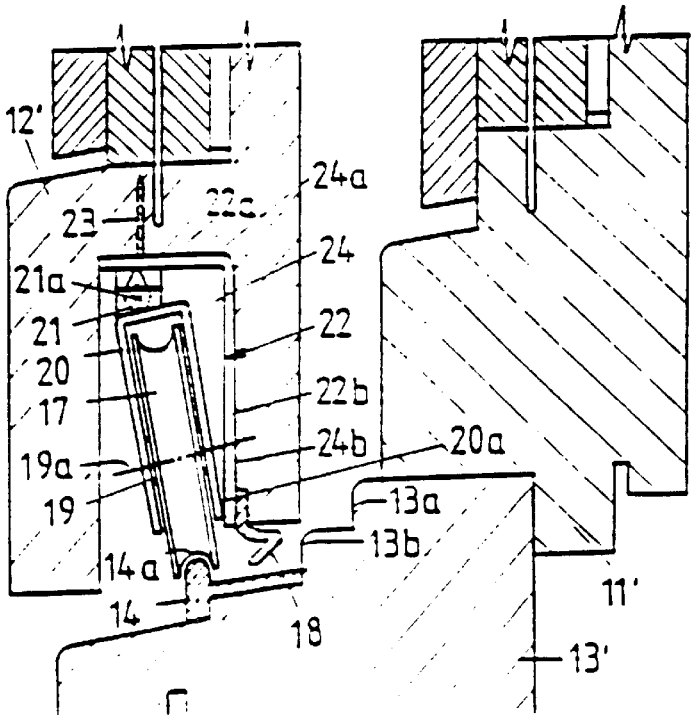

In FIGS. 3 and 4 details are shown of the one of as an example a set of two castor-formed wheels 17, which are arranged in the lower horizontal sliding panel piece 12' of the sliding panel 12 at a horizontal distance from each other, as is shown in FIG. 1.

In FIG. 3 the castor wheel 17 is shown in supporting abutment against guide surface 14*a* of the guide rail 14 in the support position of the sliding panel 12, that is to say in a position with the sliding panel 12 pushed laterally (towards the right) for supporting abutment against a vertical guide surface 13*a* in the casement 13 and having a sealing strip 18, which is fastened to the sliding panel 12, pressed for sealing abutment against a sealing surface 13*b* in the horizontal bottom piece 13' of the casement 13. Corresponding sealing strips are present at the remaining three sliding panel pieces 12", 12'", 12"" of the sliding panel and equivalent sealing strips are present in an upper horizontal frame piece 13" and in the one vertical frame piece 13'" and in an equivalent one vertical support panel piece 11"".

In the illustrated embodiment the sealing surface 13*b* (FIGS. 3 and 4) is arranged in the horizontal bottom piece 13' of the frame 13, while a corresponding sealing surface can be arranged in upper, horizontal frame piece 13" and in the one vertical frame piece 13'" and in the equivalent one support panel piece 11"".

The castor wheel 17 itself is rotatably mounted about a first horizontal axis 19*a* on a rotary pin 19, which extends at right angles to the sliding direction of the sliding door and which is fastened in a holder member in the form of an inverted U-shaped bearing profile 20. The bearing profile 20 is pivotably mounted on its side about a second horizontal axis 21*a* on a rotary pin 21 in the one leg 22*a* of an inverted L-shaped fitting 22, the second horizontal axis 21*a* extending parallel to the sliding direction of the sliding panel 12. The one leg 22*a* of the fitting 22 is fastened with screws 23 to the bottom 24*a* of a U-shaped cavity 24 on the under side of the sliding panel 12, while opposite leg 22*b* of the fitting forms a support laterally against the equivalent one side surface 24*b* of the cavity 24.

The bearing profile 20 is pivotably mounted about the axis 21*a*, which in the illustrated embodiment is located laterally outside the central plane of the castor wheel 17*a* and laterally outside the central plane of the bearing profile 20 and also the central plane of the sliding panel 12, that is to say laterally displaced towards the side which faces away from the support panel 11. Consequently provision is made for the weight of the sliding panel in the support position, as shown in FIG. 3, to produce a turning moment in the bearing profile 20 about the axis 21*a* in a direction outwardly from the support panel 11. The bearing profile 20 having associated castor wheel 17 can consequently be pivoted about guide surface 14*a* of the guide rail 14 by means of the weight of the sliding panel from the unstable support position, which is illustrated in FIG. 3, to the relatively stable sliding position, which is illustrated in FIG. 4.

In the sliding position, as illustrated in FIG. 4, the lower inner edge 20*a* of the bearing profile 20 supportingly abuts against the equivalent lower L-leg 22*b* of the fitting 22. By way of support means (not shown), the bearing profile 20 can if necessary forcibly guide the upper portion of the sliding panel 12 in a pivotal movement away from the corresponding upper portion of the support panel 11 in order to adjust the sliding panel as much as possible into a vertical position.

In FIG. 3A the wheel 17 is shown in an unstable position, as correspondingly shown in FIG. 3, where radial plane A of the wheel 17 coincides with a vertical plane B through the rail 14. In the unstable support position as shown in FIG. 3A, the wheel 17 remains vertical so long as the sliding panel is barred in the support position. However, as soon as the barring engagement is removed, the weight of the sliding panel causes the vertically disposed fitting 20 of the wheel to turn about the laterally displaced pivotal axis 21*a* of the fitting 20 into the position shown in FIG. 4A . In FIG. 4A the wheel 17 is shown in a stable sliding position, as correspondingly shown in FIG. 4, where the radial plane of the wheel 17 is swung out about 9° from the vertical plane B.

In FIG. 3B the wheel 17 is shown in an unstable support position, where radial plane A of the wheel 17 forms an angle of about 1° relative to the radial plane. In this instance radial plane A of the wheel passes through pivotal axis 21*a* of the fitting 20, but nevertheless the obliquely disposed wheel 17 and associated obliquely disposed fitting 20 form a turning moment about the pivotal axis 21*a* of the fitting 20. In FIG. 4B the wheel 17 is shown in a stable sliding position, where radial plane A of the wheel 17 is swung out about 10° from the vertical plane B.

In FIG. 5 a regulating pin 25 is shown fastened at the lower L-leg 22*b* of the fitting 22 so as to form a regulatable stop for the lower inner edge 20*a* of the bearing profile 20 for regulating the position of the sliding panel 12 to substantially a vertical position in the sliding position.

Alternatively remaining guide means, not shown can be employed in order to ensure the upper end of the sliding panel in place in the intended position in the upper guide 15*a*.

On one vertical support panel piece 11'" of the support panel 11 there are fastened in a lower and an upper cavity 26' and 26" respectively a respective hook-shaped guide member 27' and 27", as is indicated in FIG. 1 and in FIGS. 6 and 7 respectively. Correspondingly on one vertical sliding panel piece 12"" of the sliding panel 12 there is fastened in a lower and an upper cavity 28' and 28" respectively a respective hook-shaped guide member 29' and 29". The guide members 27", 27" and 29', 29" are each provided with obliquely extending guide surfaces 27*a* and 29*a* which serve to forcibly guide the sliding panel 12 in a combined lateral and longitudinal sliding movement. In FIG. 6 the sliding panel 12 is shown in an almost closed position and in FIG. 7 in a fully closed position, the pairs of guide members 27', 29' and 27", 29" engaging each other during the closing movement of the sliding panel 12 from the position in FIG. 6 to the position in FIG. 7 and forcibly guiding the sliding panel 12 sideways in a direction towards the support panel 11 at the rear end of the sliding panel 12 (at the sliding panel piece 12"").

The last closing movement between the positions as illustrated in FIGS. 6 and 7 is ensured by way of an actuating means in the form of an espagnolette-locking mechanism 30, as illustrated in FIG. 8A set of second guide members 31,32 at one casement piece 13'" of the casement 13 cooperates with pins 33,34 of the espagnolette mechanism so as to forcibly guide the front, vertical sliding panel piece 12''' of the sliding panel 12 sideways towards the support panel 11, while the first set of guide members 2',29' and 27",29" correspondingly forcibly guides the rear, vertical sliding panel piece 12" correspondingly sideways towards the support panel 11.

Figure 8:
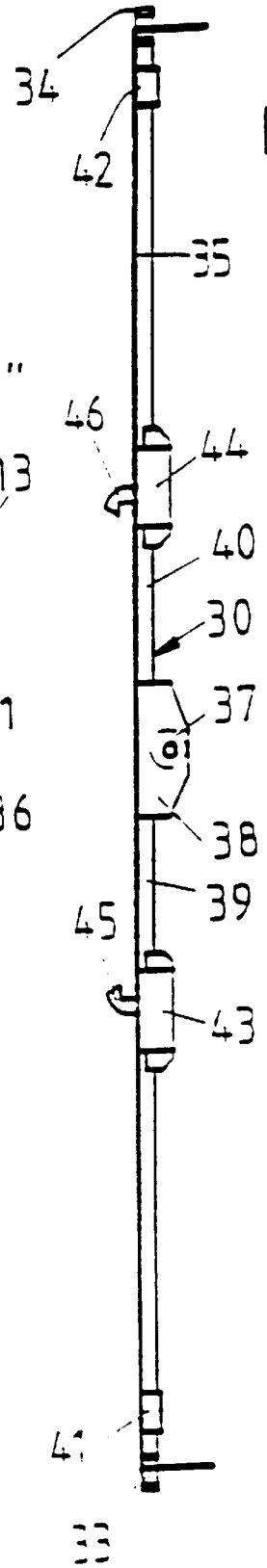
FIG. 8 shows in side view an actuating means in the form of an espagnolette mechanism.

The espagnolette-locking mechanism 30, which is of known construction per se, is as illustrated in FIG. 8, fastened in a fitting 35, which in a manner not shown further is fastened to front sliding panel piece 12''' of the sliding panel 12. A door turner is provided with a handle 36 (see FIGS. 1 and 2) on each side of the sliding panel 12. The door turner with the handles 36 is fastened to a rotary disc 37 which is rotatably mounted in a stationary control box 38. To diametrically opposite edge portions of the rotary disc 37 there are pivotably fastened oppositely directed slide rods 39,40. Outermost, that is to say axially outside the fitting 35 and outside upper and lower end edges of the sliding panel 12, the rods 39,40 are extended by the pins 33,34, which cooperate with the guide members 31,32. Between the box 38 and the respective pin 33,34 the slide rods 39,40 separately pass through an equivalent guide 41,42 and a lock box 43,44. From each of the lock boxes 43,44 a hook-shaped lock bolt 45 and 46 projects outwardly from the fitting 35, which cooperates with an equivalent locking member 47 and 48 in the frame piece 13'''.

The lock bolt 45 (46) is adapted to be pivoted by means of the handle 36 between a locking position and a released positioned. In the sliding position of the sliding panel 12 the handle 36 is correspondingly pivoted to a position equivalent to the released position of the lock bolt, and in such a position the lock bolt can be led into engagement with associated locking member 47 (48) during the closing movement of the sliding panel. Thereafter the lock bolt is pivoted forcibly from the released position to the locking position by equivalent pivoting of the handle 36.

At the same time as the lock bolts 45,46 are brought into locking engagement with the locking members 47,48 the sliding panel 12 is forcibly guided sideways from the sliding position (FIG. 4) to the support position (FIG. 3) towards the support panel 11 in that the pins 33,34, at the same time as they are pushed axially outwards by the slide rods 39,40, are forcibly guided by oblique surfaces 31*a*,31*b* (see FIG. 9) of the guide members 31 (32) laterally inwards towards the support panel 11 and in the sliding direction of the sliding panel inwardly towards the frame piece 13'''.

During the side displacement of the sliding panel 12 towards the support panel 11 the sliding panel 12 is lifted relative to the frame 13 by pivoting of the profile 20 with the castor wheel 17 from the position shown in FIG. 4 to the position shown in FIG. 3, mainly by means of the pushing force which is exerted from the pins 33,34 towards the guide members 31,32. In the support position, as illustrated in FIG. 3, the sliding panel is consequently pushed into place in an unstable support position.

After reverse pivoting of the handle 36 from the position which corresponds to the locking position of the locking mechanism 30 to the position which corresponds to the released position of the locking mechanism 30, the sliding panel 12 has, as a result of the said turning moment which is produced by the weight of the sliding panel 12, the opportunity to be lowered into place in a stable sliding position. Simultaneously with this the sliding panel 12 will be moved laterally outwards from the support panel 11, so that the sealing strips 18 are released from impacting sealing surfaces and the sliding panel can thereby be moved relatively inhindered in the sliding direction on the guide rail 14.

By means of the locking mechanism 30 and guide members which are modified relative to the guide members 32,33, it will also be possible in a manner not shown further, to bar the sliding panel 12 in the fully open end position and in arbitrary intermediate positions without changing the sliding position of the sliding panel. Alternatively with the aid of further modified guide members the sliding panel can in such positions be locked in positions corresponding to the support position illustrated in FIG. 3.

In FIGS. 12–14 an alternative construction is schematically illustrated where there can be employed lower guide rail 14 and upper guide rail 114 and a set of lower castor wheels 17 and a set of upper castor wheels 117, which are separately pivotably mounted in a similar manner to that which is illustrated in FIGS. 3 and 4. The sliding panel 112 will consequently be able to be pivoted about a lower pivot pin 21 and an upper pivot pin 121 from the sliding position illustrated in FIG. 12 via the unstable intermediate position illustrated in FIG. 13 to the stable support position illustrated in FIG. 14.

In such a case the bearing profile 120 is, as shown in FIG. 15, provided with a pivot pin 121, which is pivotably mounted in a bearing 50 on a control pin 51 which is axially moveable in a guide 52 in the sliding panel 112 against the force of a spring 53, which is compressed in the intermediate position as illustrated in FIG. 13 and which if necessary can exert a smaller spring force in the outer positions, as illustrated in FIGS. 12 and 14.

In the alternative construction as illustrated in FIGS. 12–15 smaller outswung angles from the unstable middle position can be employed than from the unstable support position in the construction of FIGS. 1–11 and thereby smaller vertical movements than in the construction of FIGS. 1–11. In addition the guide members 27', 29' and 27", 29" can if desired be omitted or these can be replaced by simpler guide members, since the readjustment of the sliding panel from the sliding position to the support position, and vice versa, can be ensured by displacement of the sliding panel past a dead centre-forming intermediate position as illustrated in FIG. 13. In the locking position of the locking mechanism (corresponding to the position of the sliding panel in FIG. 14) unintentional pivoting of the sliding panel about the dead centre-forming intermediate position can be prevented.

Concrete examples are not shown herein of sliding windows, cupboard sliding doors or similar constructions, since these can be designed substantially correspondingly as described for sliding doors, but by way of example only with a handle on one side of the sliding panel and with sheet material on the sliding panel and the support panel instead of the illustrated glass panels.

Above there is illustrated a preferred embodiment where the central radial plane of the support wheel 17 in the support position of the sliding panel 12 coincides with a central vertical plane through the associated guide rail 14, whereby the weight of the sliding panel 12 is transferred centered through support wheel 17 and associated guide rail 14. There is guaranteed a moment arm in said support position in that the second axis 21*a*, that is to say the pivotal axis 21*a* between the sliding panel 12 and fitting 22 of the support wheel 17 is located laterally displaced relative to the vertical plane through guide rail 14 and support wheel 17.

In an alternative construction, not shown the central radial plane through the support wheel coincides with the said second axis 21*a*. In order to ensure a moment arm between the sliding panel 12 and the support wheel 17 also in the support position of the sliding panel provision is made for locating a vertical plane through the second axis displaced laterally outwards relative to the vertical plane through the associated guide rail 14 of the support wheel 17. More specifically in the support position of the sliding panel 12 provision is made for the support wheel 17 to run inclining slightly outwards, while in the sliding position of the sliding panel 12 the support wheel 17 runs inclining more severely outwards. In the alternative embodiment a corresponding automatic pivoting about of the support wheels 17 can be achieved and an associated lowering down of the sliding panel 12 towards a stable sliding position, immediately the barring engagement of the sliding panel in its support position is removed.

What is claimed is:

1. In combination;

a frame;

a rail extending horizontally along said frame;

a support panel secured to said frame and to one side of said rail;

a sliding panel having at least one wheel rotatably mounted on said rail for movement of said sliding panel along said rail; and at least one fitting having said wheel rotatably mounted therein on an axis perpendicular to said fitting, said fitting being pivotally mounted in said sliding panel on a pivot axis parallel to said rail and disposed on a side of said rail opposite said support panel whereby each said wheel is pivotal on said rail under the weight of said sliding panel from an unstable support position with said sliding panel adjacent said support panel to a stable sliding position with said sliding panel spaced laterally of said support panel.

2. The combination as set forth in claim 1 which further comprises a locking mechanism for locking said sliding panel to said support panel to maintain said wheel in said unstable support position.

3. The combination as set forth in claim 1 wherein said wheel is disposed in a vertical plane spaced laterally of said pivot axis in said unstable support position.

4. The combination as set forth in claim 3 wherein said wheel is disposed at an angle of about 9° from a vertical plane in said stable sliding position.

5. The combination as set forth in claim 1 wherein said wheel is disposed in a plane passing through said pivot axis and disposed angularly of a vertical plane.

6. The combination as set forth in claim 5 wherein said wheel is disposed at an angle of about 10° from a vertical plane in said stable sliding position.

7. The combination as set forth in claim 1 which further comprises a sealing strip secured to said sliding panel for sealingly engaging said support panel in said unstable support position of said wheel and for being spaced from said support panel in said stable sliding position of said wheel.

8. The combination as set forth in claim 1 wherein said pivot axis of said fitting is disposed above said wheel.

9. The combination as set forth in claim 1 wherein said sliding panel has a plurality of said wheels mounted on said rail.

10. The combination as set forth in claim 1 wherein said rail extends below said sliding panel and a second rail extends above said sliding panel in said frame and wherein said sliding panel has a plurality of said wheels mounted on each said rail.

11. The combination as set forth in claim 1 which further comprises guide members on each of said panels for guiding said sliding panel laterally relative to said support panel.

12. The combination as set forth in claim 11 which further comprises a locking mechanism for guiding said sliding panel laterally towards said support panel to move said wheel from said stable position to said unstable support position.

13. The combination as set forth in claim 12 wherein said locking mechanism is an espagnolette-mechanism having a rotatable handle and axially movable guide pins connected to said handle for movement thereby into and out of engagement with said guide means.

14. The combination as set forth in claim 13 wherein said locking mechanism further includes a plurality of locking bolts in said sliding panel and mating lock members in said frame for receiving said bolts with said wheel in said unstable support position.

15. The combination as set forth in claim 11 wherein each guide member is of a hook-shape with an obliquely extending guide surface for mating with an opposed guide member.

* * * * *